US005864071A

United States Patent [19]

Kosco

[11] Patent Number: 5,864,071

[45] Date of Patent: Jan. 26, 1999

[54] POWDER FERROUS METAL COMPOSITIONS CONTAINING ALUMINUM

[75] Inventor: John C. Kosco, St. Marys, Pa.

[73] Assignee: Keystone Powdered Metal Company, St. Marys, Pa.

[21] Appl. No.: 847,423

[22] Filed: Apr. 24, 1997

[51] Int. Cl.[6] ..... C22C 1/04; C22C 33/02; C22C 38/06; B22F 3/12

[52] U.S. Cl. ..... 75/246; 75/255; 419/32; 419/37; 419/38; 419/39; 419/57

[58] Field of Search ..... 75/246, 255; 419/32, 419/38, 39, 57, 37

[56] References Cited

U.S. PATENT DOCUMENTS

| | | | |
|---|---|---|---|
| 2,956,304 | 10/1960 | Batten et al. | 18/2.5 |
| 3,425,813 | 2/1969 | Orlemann | 29/183.5 |
| 3,520,680 | 7/1970 | Orlemann | 75/212 |
| 3,813,196 | 5/1974 | Backstrom et al. | 425/7 |
| 4,240,831 | 12/1980 | Ro et al. | 75/228 |
| 4,283,465 | 8/1981 | Morimoto et al. | 428/566 |
| 4,314,849 | 2/1982 | Ro et al. | 75/228 |
| 4,331,478 | 5/1982 | Ro et al. | 75/228 |
| 4,350,529 | 9/1982 | Ro et al. | 75/228 |
| 4,398,951 | 8/1983 | Wallwork | 75/124 |
| 4,472,196 | 9/1984 | Argyropovlos et al. | 75/129 |
| 4,529,445 | 7/1985 | Buschow | 75/123 E |
| 4,662,939 | 5/1987 | Reinshagen | 75/246 |
| 4,836,850 | 6/1989 | Kemp, Jr. et al. | 75/251 |
| 4,925,502 | 5/1990 | Yamagishi et al. | 148/311 |
| 5,098,470 | 3/1992 | Wood et al. | 75/255 |
| 5,104,444 | 4/1992 | Shioda et al. | 75/249 |
| 5,238,645 | 8/1993 | Sikka et al. | 420/79 |

(List continued on next page.)

OTHER PUBLICATIONS

J. S. Dunning, An Iron–Aluminum Molybdenum Alloy as a Chromium–Free Stainless Steel Substitute, U.S. Bureau of Mines Report, Report of Investigations 8654, pp. 1–14.

John S. Dunning, Max L. Glenn and Howard W. Leavenworth, Jr., Substitutes for Chromium in Stainless Steel, Metal Progress, vol. 126, No. 5, Oct., 1984, pp. 19–24.

S. D. Sastry, P. K. Rohatgi, K. P Abraham, Y.V.R.K. Prasad, Preparation and Mechanical Processing of Fe–12Cr–6A1 Ferritic Stainless Steel, Metals Technology, vol. 7, No. 10, Oct., 1980, pp. 393–396.

John H. Reinshagen and Richard P. Mason, Improved Corrosion Resistant Stainless Steel Based P/M Alloys, Presented at the 1992 Powder Metallurgy World Congress, Jun. 21–26, San Francisco, California, pp. 1–13.

John H. Reinshagen and Thomas J. Bockius, Stainless Steel Based P/M Alloys With Improved Corrosion Resistance, A Contribution to the 1995 International Conference on Powder Mettallurgy and Particulate Materials, May 14–17, 1995, Seattle, Washington, pp. 1–12.

(List continued on next page.)

*Primary Examiner*—Daniel J. Jenkins
*Attorney, Agent, or Firm*—Kirkpatrick & Lockhart LLP

[57] ABSTRACT

Powdered ferrous metal compositions are disclosed which provide for increased corrosion resistance through the admixing of powder aluminum containing compositions with standard ferrous metal compositions prior to forming the powder metal parts. In a preferred embodiment, the aluminum ranges is admixed as an FeAl alloy powder with the standard ferrous metal composition. The present invention further includes a powder metal ferrous part formed from the composition produced by a method including the steps of (i) providing a ferrous powder metal composition, (ii) admixing a powder aluminum containing composition with the ferrous composition to form a blended mixture, and (iii) forming a powder metal part from at least a portion of the blended mixture. In accordance with the present invention, the admixing of powder aluminum with powder steels increases the corrosion resistance of the resulting part formed from the mixture and allows the use in applications in which the parts are exposed to more aggressive corrosive environments than possible in prior art compositions.

67 Claims, 14 Drawing Sheets

U.S. PATENT DOCUMENTS

| | | | |
|---|---|---|---|
| 5,269,830 | 12/1993 | Rabin et al. | 75/246 |
| 5,278,881 | 1/1994 | Kato et al. | 376/305 |
| 5,334,255 | 8/1994 | Dorfman et al. | 75/255 |
| 5,399,438 | 3/1995 | Tateishi et al. | 428/548 |
| 5,427,601 | 6/1995 | Harada et al. | 75/235 |
| 5,529,604 | 6/1996 | Reinshagen | 75/246 |
| 5,590,384 | 12/1996 | Reinshagen | 419/6 |
| 5,637,816 | 6/1997 | Schneibel | 75/240 |

OTHER PUBLICATIONS

Improving Corrosion Resistance of Stainless Steel PM Parts, Metal Powder Report, vol. 46, No. 9, Sep., 1991, pp. 22–23.

Gustavo Luis Tamayo, Microstructures, Transformations and Properties of Oxidation–Resistant, Iron–Base, Aluminum–Modified Alloys, Dec., 1982, pp. 1–60.

Samir K. Banerji, An Austenitic Stainless Steel Without Nickel and Chromium, Metal Progress, vol. 113, No. 4, Apr., 1978, pp. 59–62.

POWDER FERROUS METAL COMPOSITIONS CONTAINING ALUMINUM

BACKGROUND OF THE INVENTION

The present invention relates to processes for producing ferrous metal compositions having increased corrosion resistance and the compositions and parts made therefrom. More particularly, the invention relates to the discovery that the introduction of powdered aluminum containing compositions into powder standard ferrous metal compositions results in modified compositions that have increased corrosion resistance.

Iron-chromium-nickel and iron-chromium alloys, specifically in the form of stainless steels, have found widespread use in industry due to the highly desirable mechanical and corrosion properties of stainless steels in comparison with conventional low alloy steels. The addition of substantial quantities of chromium to steels results in the formation of a highly protective chromium oxide layer on the surface of the steel that generally protects the underlying metal from corrosion and also provides an excellent surface finish. The addition of nickel enhances the mechanical properties of stainless steels by promoting an austenitic structure in the alloy.

There are, however, a number of problems associated with the use of chromium and nickel. One problem is that nickel is an expensive alloy element that greatly increases the cost of the steel. Another problem is that the majority of the world production of chromium comes from a small number of foreign sources, which means that the supply of chromium is subject to the uncertainties of foreign markets. Therefore, it would be beneficial to reduce the amount of chromium and nickel used in steels.

The protective chromium oxide layer on stainless steels substantially improves the corrosion resistance of the steels to attack by chloride ions compared to low alloy steels. Because of the low resistance of low alloy steels to chloride attack, stainless steels must be used in applications that do not require the enhanced mechanical properties of stainless steels. However, stainless steels do experience higher corrosion rates in marine and other chloride containing environments and exhibit reduced lifetime corrosion performance.

The corrosion resistance of stainless and low alloy steel parts in chloride containing environments is further diminished when powder metal (P/M) steels are used to form the parts. Powder metals are produced by exposing molten metal to cooling gas(es) and/or liquid(s) in such a way that the molten metal solidifies in a particulate powder. The process of producing the powder is known as atomization. An example of a conventional water atomization process is described in U.S. Pat. No. 2,956,304 issued to Batten. While the formability of powder metal provides increased versatility and allows for the production of machine parts that are not readily cast or machined from wrought metal, the corrosion resistance of powder metal parts is generally substantially lower than cast or wrought metal parts. The lower resistance has been thought to be associated with the increased porosity in the compact, which results in increased surface area exposed to the environment, and also related to the exposed microstructure of the powder metal part. As a result, the market for P/M stainless steel parts is only a fraction of the wrought and cast steel markets.

A variety of different metallurgical and mechanical methods have been developed to improve the corrosion resistance of powder metal stainless and low alloy steels. For instance, in U.S. Pat. Nos. 4,240,831, 4,314,849, 4,331,478 and 4,350,529 issued to Ro et al., the inventors disclose that the production of stainless steel powders using conventional water atomization processes, such as that of Batten, resulted in a powder stainless steel that is enhanced in $SiO_2$ and depleted in chromium near the surface. The chromium depleted region near the surface of the powder resulted in increased susceptibility of the powder to corrosion. Ro et al. found that chromium depletion at the surface could be prevented in the atomization process if certain metals, "metal modifiers", are added to the molten metal prior to atomization. The metal modifiers were found to decrease the amount of silicon dioxide and increase the amount of chromium at the surface of the atomized alloy. The resultant parts formed from the alloy exhibited an improvement in the corrosion resistance over unmodified alloy parts. Ro found tin to be the preferred metal modifier, although other metals such as aluminum, lead, zinc, magnesium, and rare earth metals, were found to concentrate at the surface during atomization and reduce the surface concentration of silicon dioxide, but to a lesser extent than tin.

In U.S. Pat. No. 4,662,939 (the "'939" patent), Reinshagen disclosed a modified molded stainless steel composition, dubbed "Stainless Steel Plus™", having improved corrosion resistance over the base stainless steel that could be prepared by mixing 8–16% of an alloy powder consisting of 2–30% tin and the remainder being either copper and/or nickel with the stainless steel powder prior to molding. However, in subsequent patents, U.S. Pat. No. 5,529,604 and 5,590,384 (the "'604 and '384" patents, respectively), Reinshagen has indicated that the compositions disclosed in the '939 patent grow upon sintering and, as a result, have had only limited acceptance.

In the '604 and '384 patents, Reinshagen discloses that tin could be alloyed with the stainless steel to produce a tin stainless steel powder, similar to Ro et al., which could then be further combined with the Sn-Cu-Ni powder of the '939 patent to provide modified stainless steel powders, named "Stainless Steel Ultra™" by the inventor. Powder metal parts formed by the modified stainless steel powder exhibited improved corrosion resistance over conventional stainless steel powder metal parts and do not swell during sintering like the Stainless Steel Plus™ parts. See also Reinshagen and Bockius, "Stainless Steel Based P/M Alloys With Improved Corrosion Resistance", a contribution to the 1995 International Conference on Powder Metallurgy and Particulate Materials, May 14–17, 1995, Seattle, Wash.

Other efforts have focused on providing a more tightly compacted powder metal to achieve properties closer to that of cast and wrought materials. Methods include the use of multiple press/sintering processing, including hot forming of the metal powder, varying the treatment conditions of the powder and incorporating powders having higher iron contents. For example, increasing the sintering temperature to more completely reduce the oxide layers on the atomized metal is suggested in "Improving Corrosion Resistance of Stainless Steel PM Parts" *Metal Powder Report,* Vol. 46, No. 9, p. 22–3 (September 1991). Similar recommendations are made by Reinshagen and Mason in "Improved Corrosion Resistant Stainless Steel Based P/M Alloys" presented at the 1992 Powder Metallurgy World Congress, June 21–26, San Francisco, Calif.

Despite the aforementioned compositional and process changes, powder metal parts have not achieved corrosion resistance that is comparable to cast and wrought parts. Consequently, the market for powder stainless and low alloy steel parts remains only a small percentage of the market for wrought and cast steel parts. As such, the need exists for powder metal compositions that provide increased corrosion resistance, especially with respect to chloride, for use in powder metal parts.

BRIEF SUMMARY OF THE INVENTION

Powder ferrous metal compositions are disclosed which provide for increased corrosion resistance through the admixing of powder aluminum containing compositions to standard ferrous metal compositions prior to forming the powder metal parts. In a preferred embodiment, the aluminum ranges from 0.5 to 5.0 weight % of the mixture (all percentages herein are weight percent of the mixture unless otherwise stated) admixed as an FeAl alloy powder. The present invention further includes a powder metal ferrous part formed from the composition produced by a method including the steps of (i) providing a ferrous powder metal composition, (ii) admixing a powder aluminum containing composition with the ferrous composition to form a blended mixture, and (iii) forming a powder metal part from at least a portion of the blended mixture.

In accordance with the present invention, the addition of powder aluminum containing compositions increases the corrosion resistance of the resultant formed part which allows for use of the part in more aggressive corrosive environments than possible in the prior art. Thus, the present invention provides a ferrous metal composition that overcomes the problems associated with the prior art. These and other details, objects, and advantages of the invention will become apparent as the following detailed description of the present preferred embodiment thereof proceeds.

DETAILED DESCRIPTION OF THE INVENTION

The powder metal compositions of the present invention are based on the addition of powder aluminum containing compositions to standard powder ferrous metal compositions prior to forming parts from the steel powders. The addition of powder aluminum containing compositions, preferably in the form of FeAl alloys, to both powder stainless and low alloy steel compositions provides for increased corrosion resistance of the compositions when exposed to chlorides. In addition, the introduction of powder FeAl alloys into the standard powder ferrous compositions provides increased corrosion resistance for compositions having carbon contents up to at least 0.8%.

Aluminum has been investigated as a potential lower cost and stable supply alloying replacement for chromium in wrought and cast stainless steels for many years. Dunning et al., in "Substitutes for Chromium in Stainless Steels", *Metal Progress,* Vol. 126, No. 4, p. 19–24, (October 1984) provides a review of the use of aluminum and other alloying elements as chromium substitutes in wrought and cast stainless steel alloys. For example, wrought and cast Fe—Al—Mn alloys (fermalloys) are disclosed by Banerji in "An Austenitic Stainless Steel Without Nickel and Chromium" *Metal Progress,* Vol. 113, No. 4, pp. 58–62, (April 1978). See also, U.S. Pat. No. 4,398,951 issued to Wallwork (1983), and U.S. Pat. No. 5,278,881 issued to Kato (1994). Further, wrought and cast Fe—Al—Mo alloys are described in "An Iron-Aluminum-Molybdenum Alloy as a Chromium-Free Stainless Steel Substitute", J. S. Dunning, U.S. Dept. of the Interior, Bureau of Mines Report of Investigations 8654 (1982) available from the U.S. Government Printing Office (1982-505-002/31) and U.S. Pat. No. 5,238,645 issued to Sikka (1993). Also, the use of aluminum to enhance the high temperature corrosion resistance of wrought and cast ferritic stainless steel is discussed by Sastry et al. in "Preparation and mechanical processing of Fe—12Cr—6Al ferritic stainless steel", *Metals Technology,* Vol. 7, No. 10, p. 393–396 (October 1980).

The above alloys and methods, including those of Ro, have attempted to incorporate aluminum directly into the solid matrix of the alloy. Incorporated in this manner, aluminum can undesirably alter the properties of solid matrix, such as by increasing the brittleness of the alloy. However, in most instances, the undesirable property variations in these metals are an unavoidable consequence of the objective of introducing aluminum as a replacement for chromium in the solid matrix.

Figure 1A:
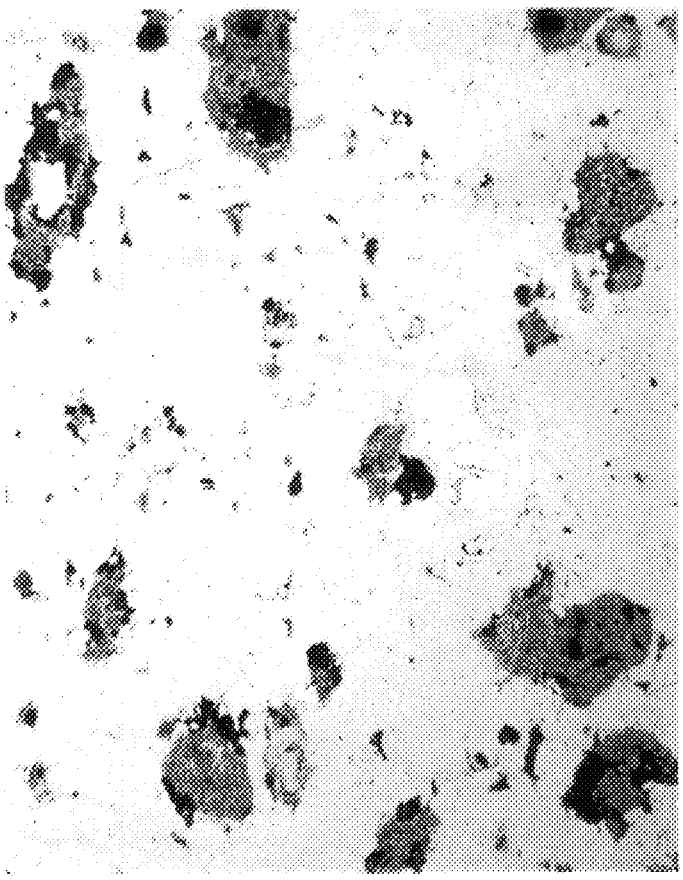
FIGS. 1(*a*) and (*b*) are 100× photographs showing the microstructure of a 410 base alloy and a 410 alloy with admixed FeAl, respectively.
Figure 1B:
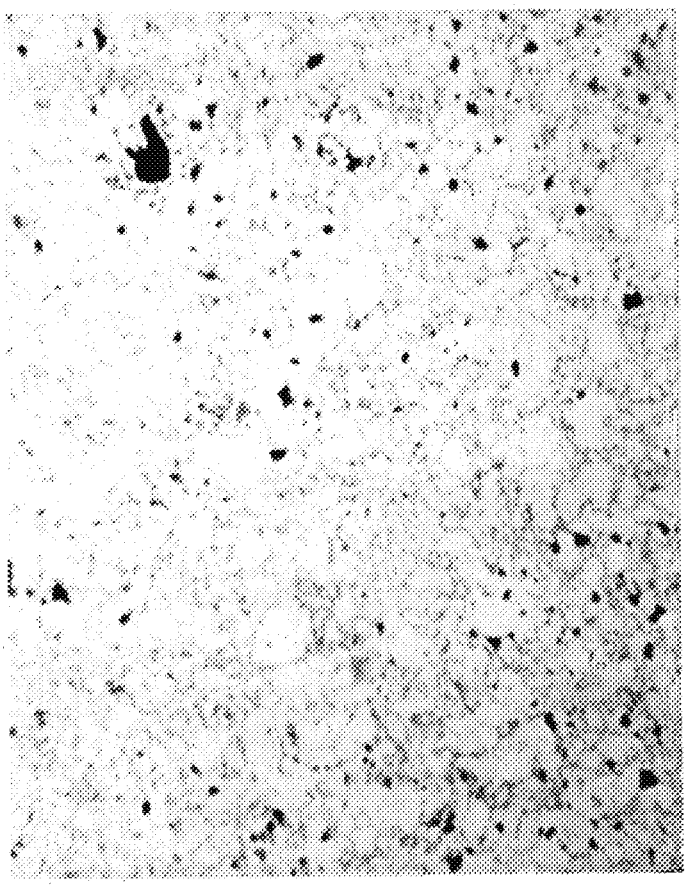
Figure 2:
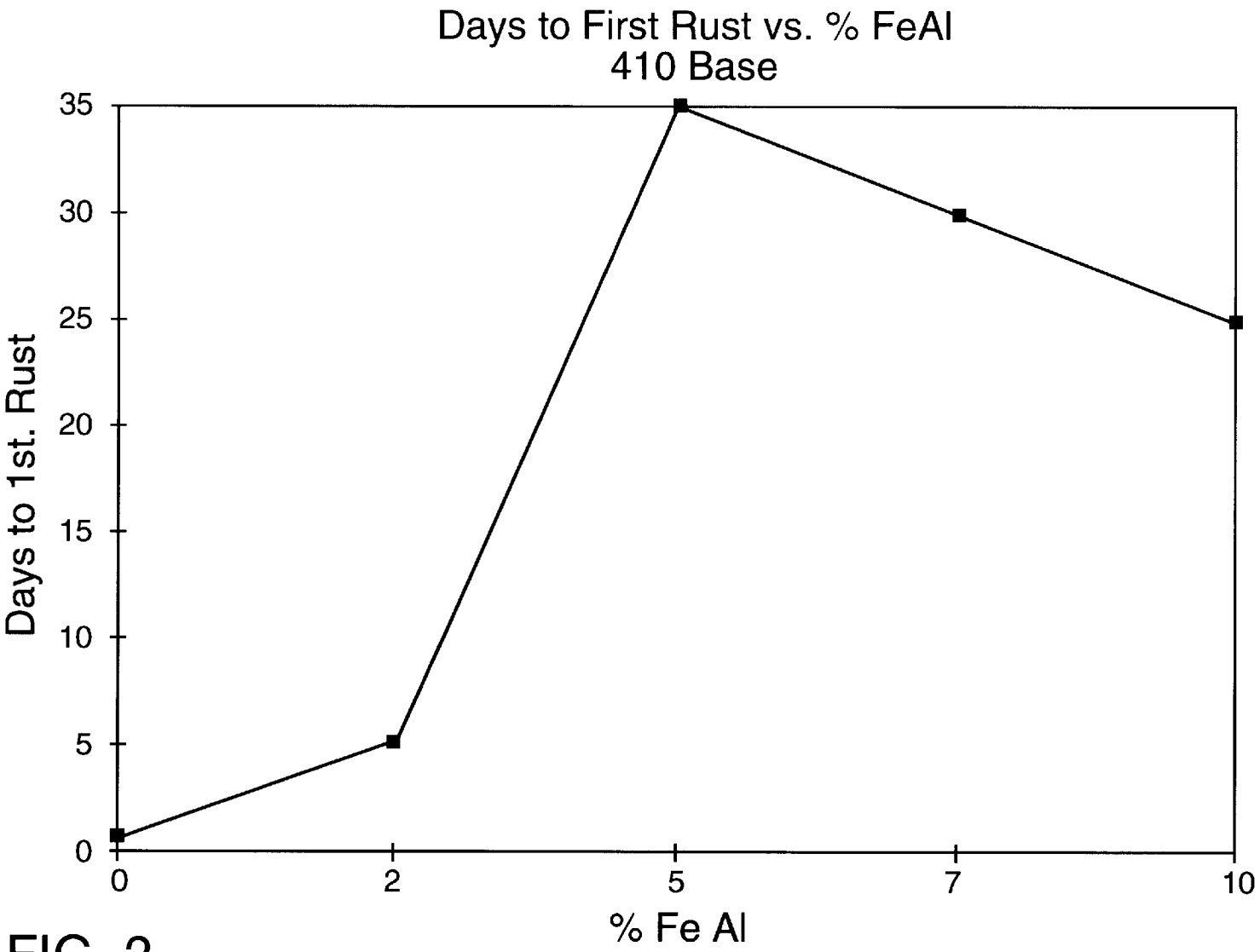
FIG. 2 is a plot of Days to First Rust versus % addition of FeAl to the 410 base alloy.
Figure 3:
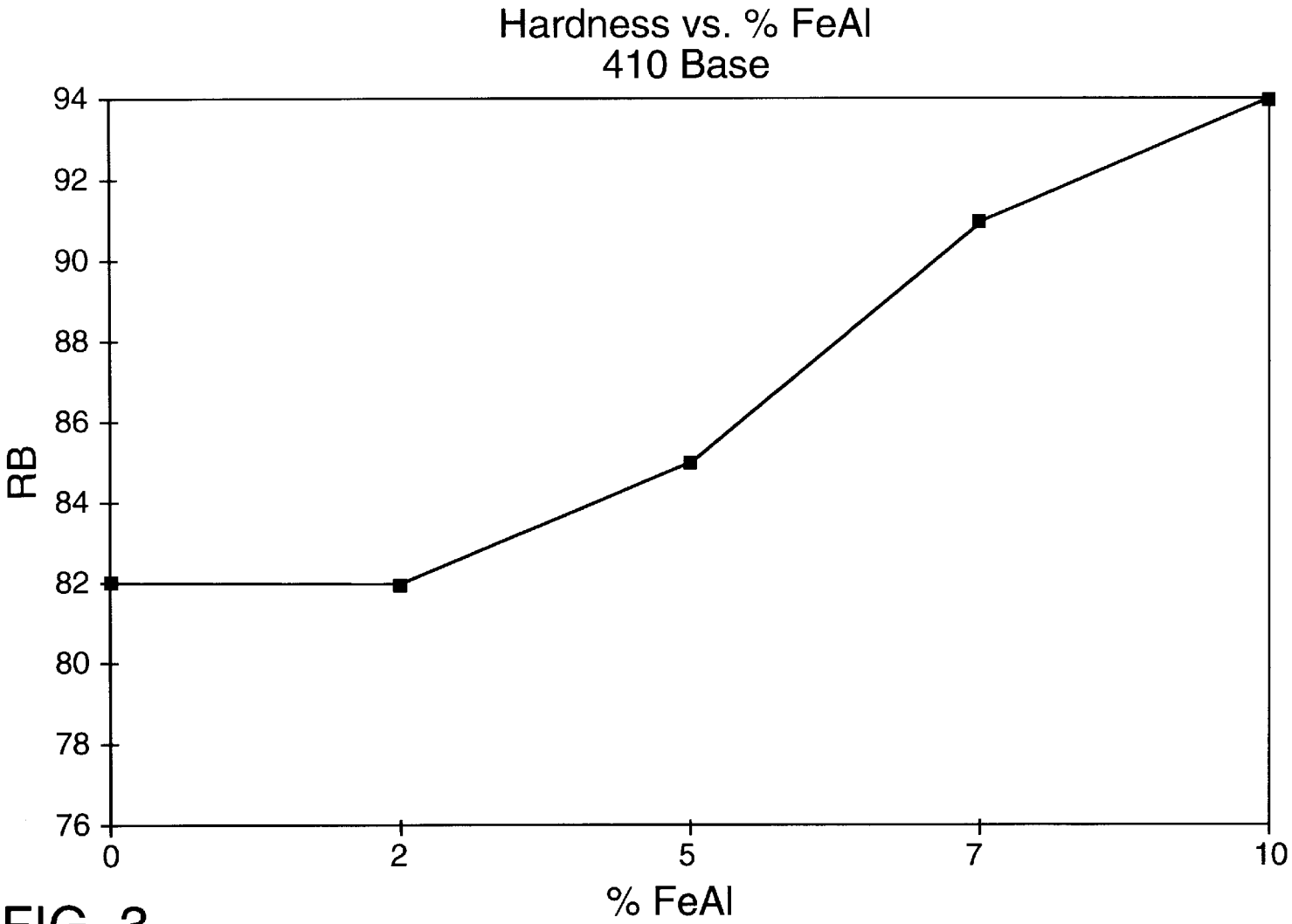
FIG. 3 is a plot of Rockwell B Hardness versus % addition of FeAl to the 410 base alloy.
Figure 4:
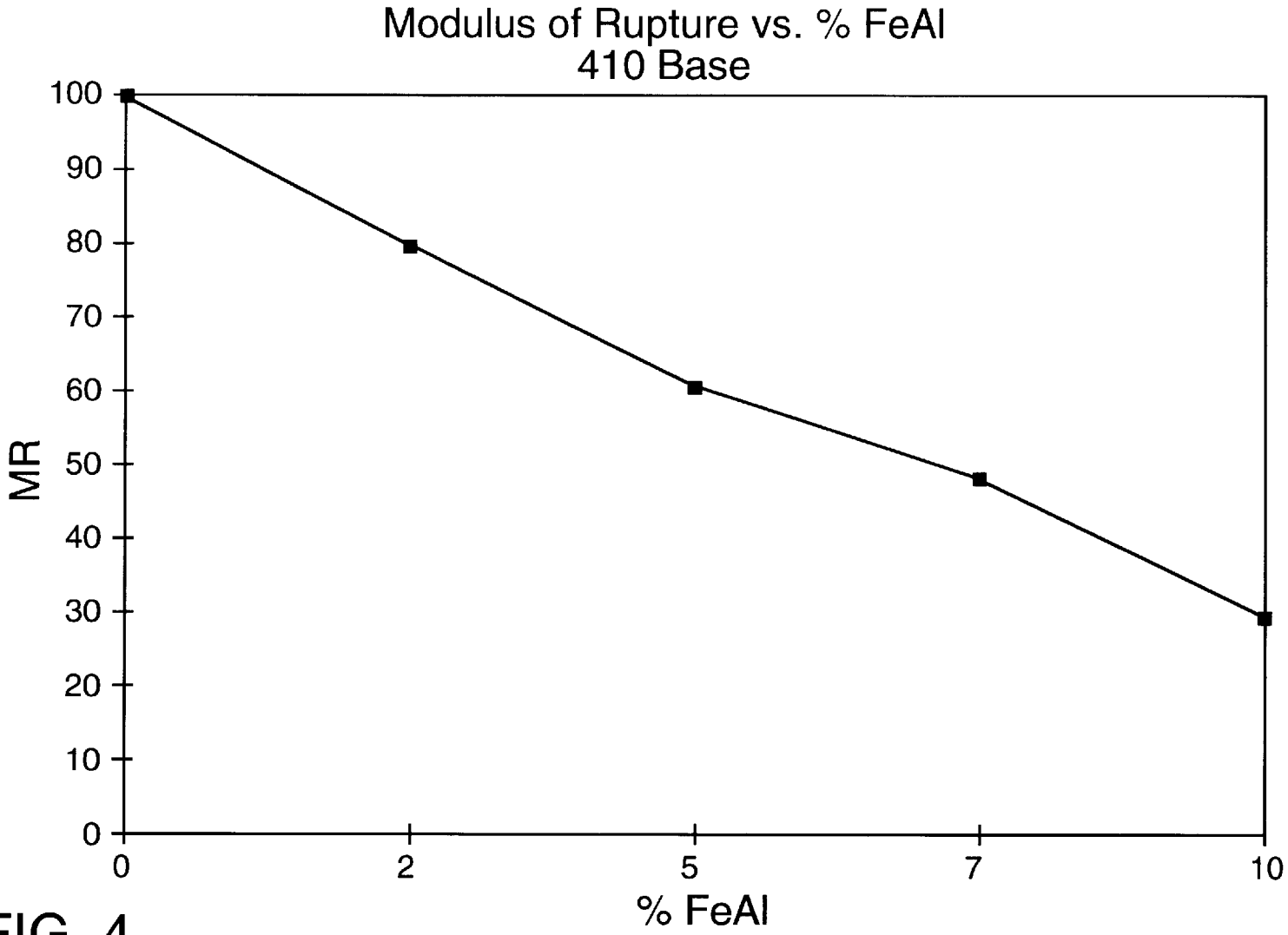
FIG. 4 is a plot of Modulus of Rupture (ksi) versus % addition of FeAl to the 410 base alloy.
Figure 5:
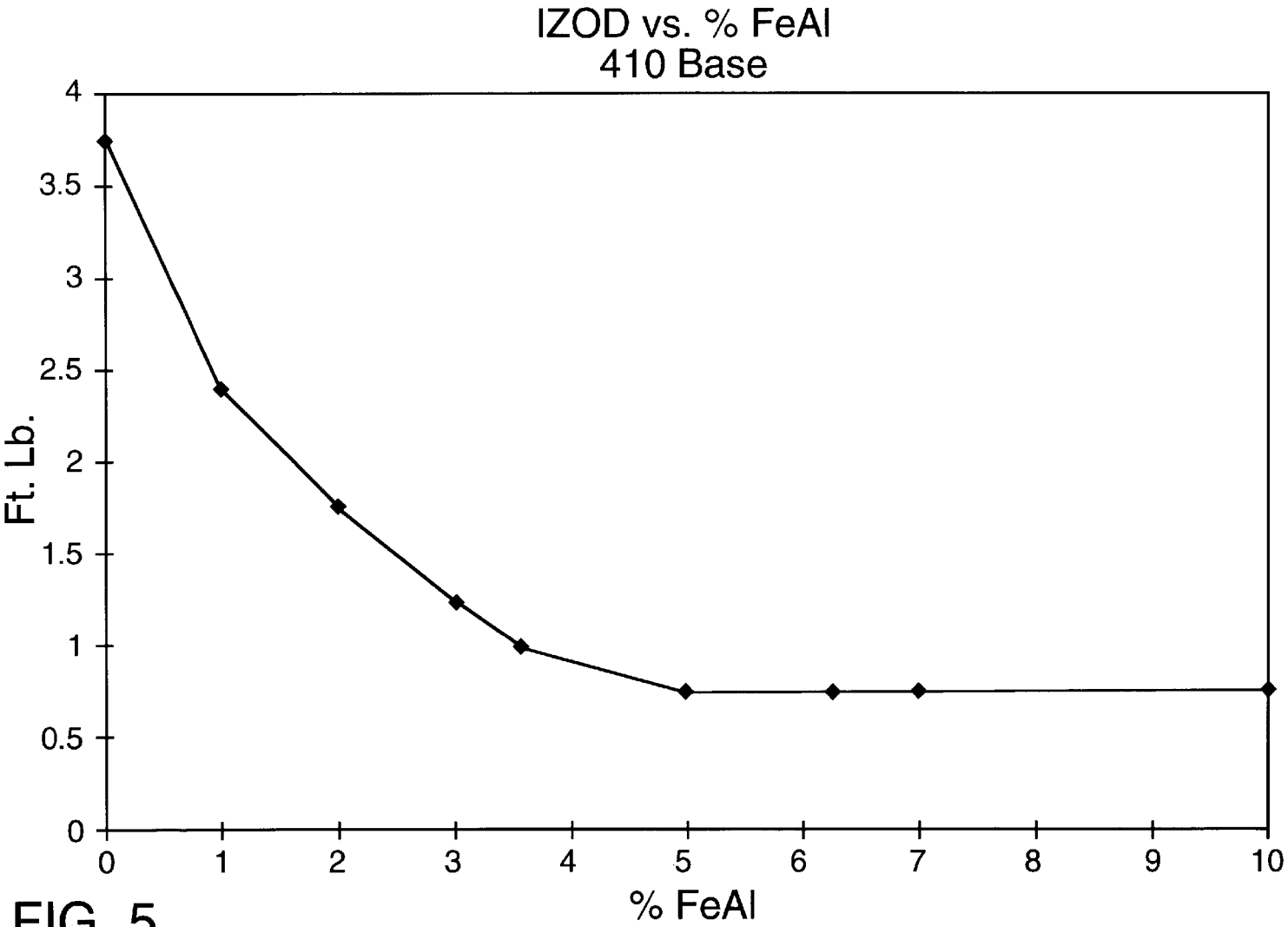
FIG. 5 is a plot of IZOD impact energy (ft.lb) vs. % addition of FeAl to the 410 base alloy.
Figure 6:
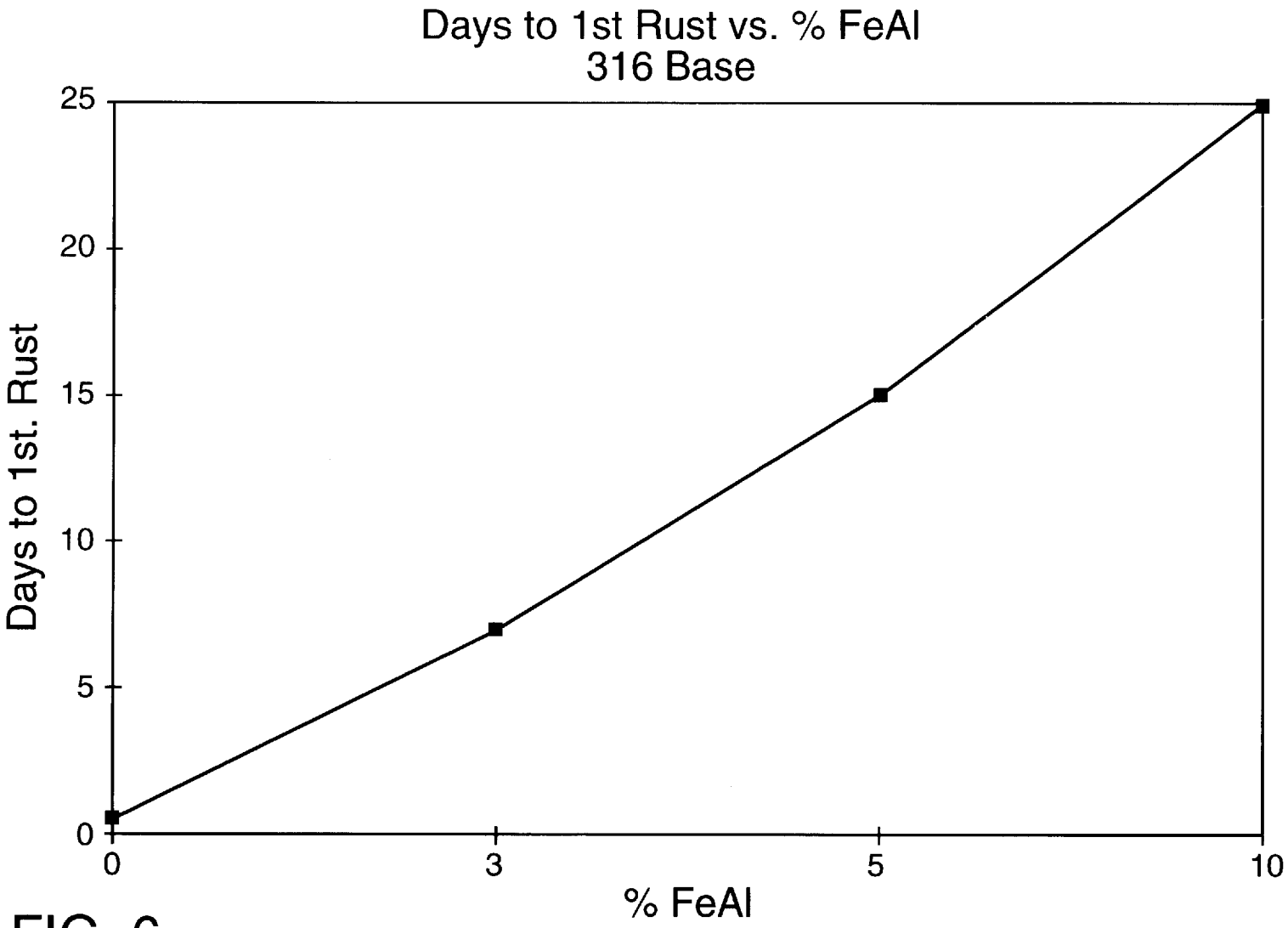
FIG. 6 is a plot of Days to First Rust vs. % addition of FeAl to the 316 base alloy.
Figure 7:
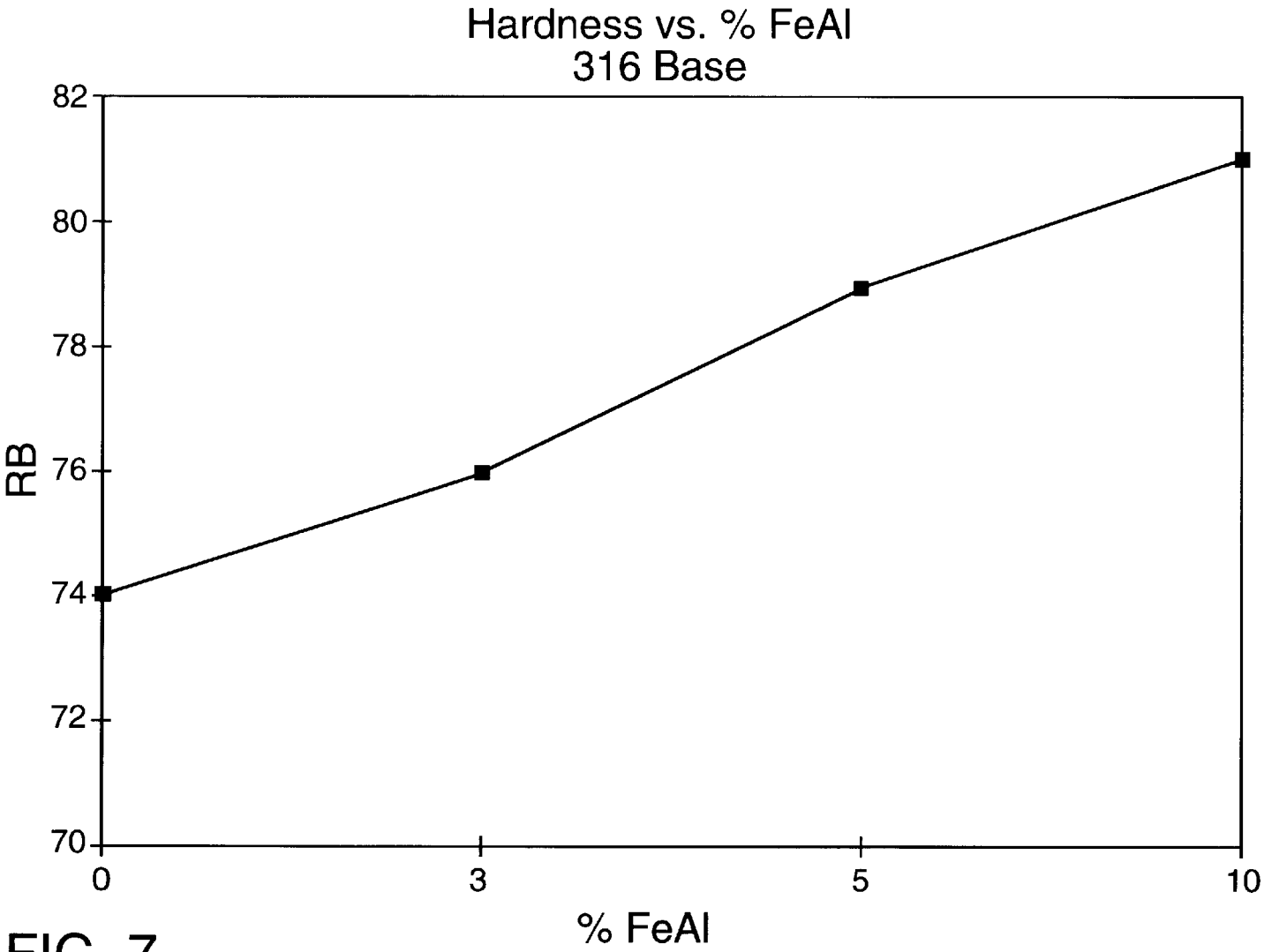
FIG. 7 is a plot of Rockwell B Hardness vs. % addition of FeAl to the 316 base.
Figure 8:
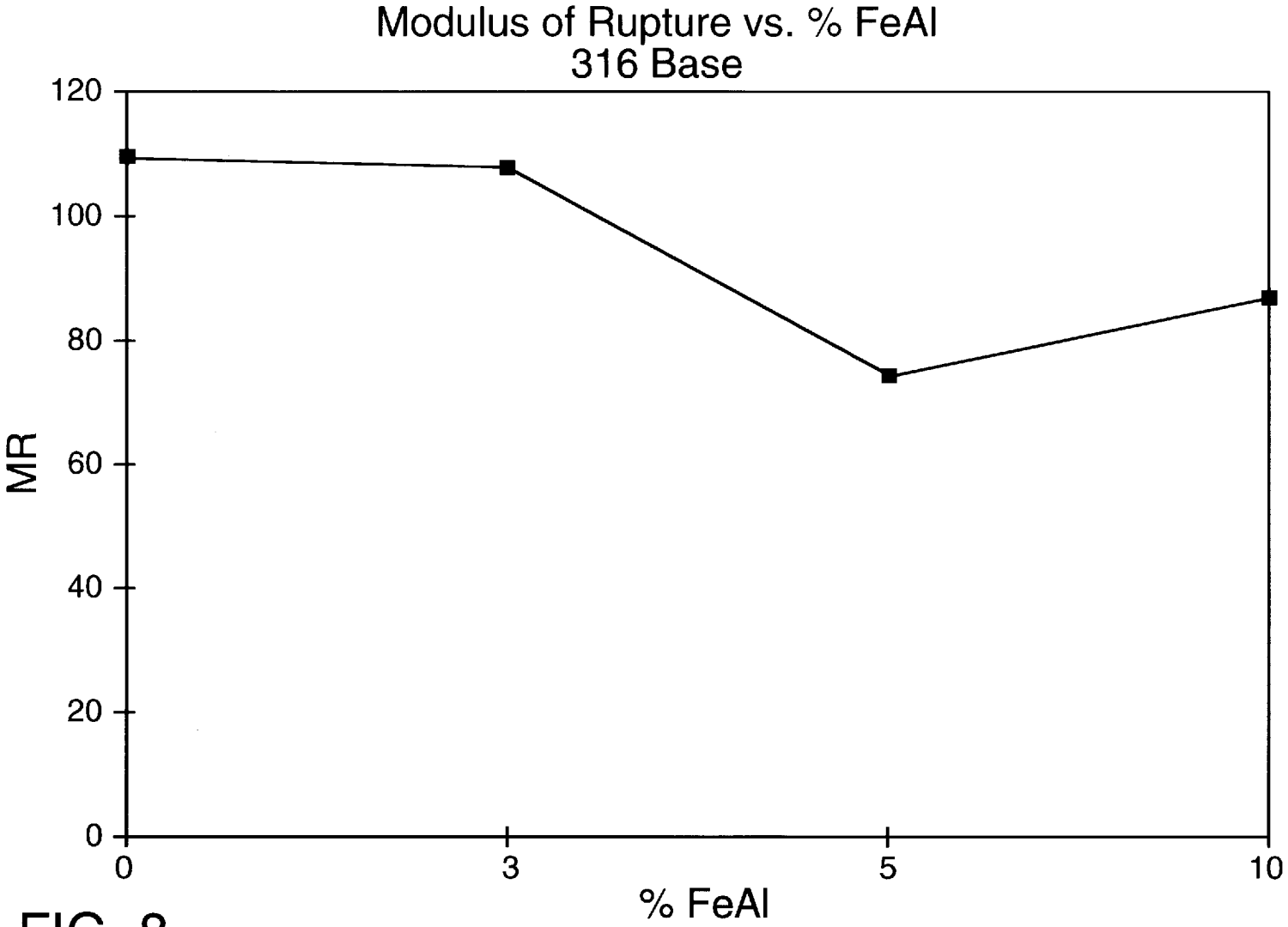
FIG. 8 is a plot of Modulus of Rupture (ksi) vs. % addition of FeAl to the 316 base.
Figure 9:
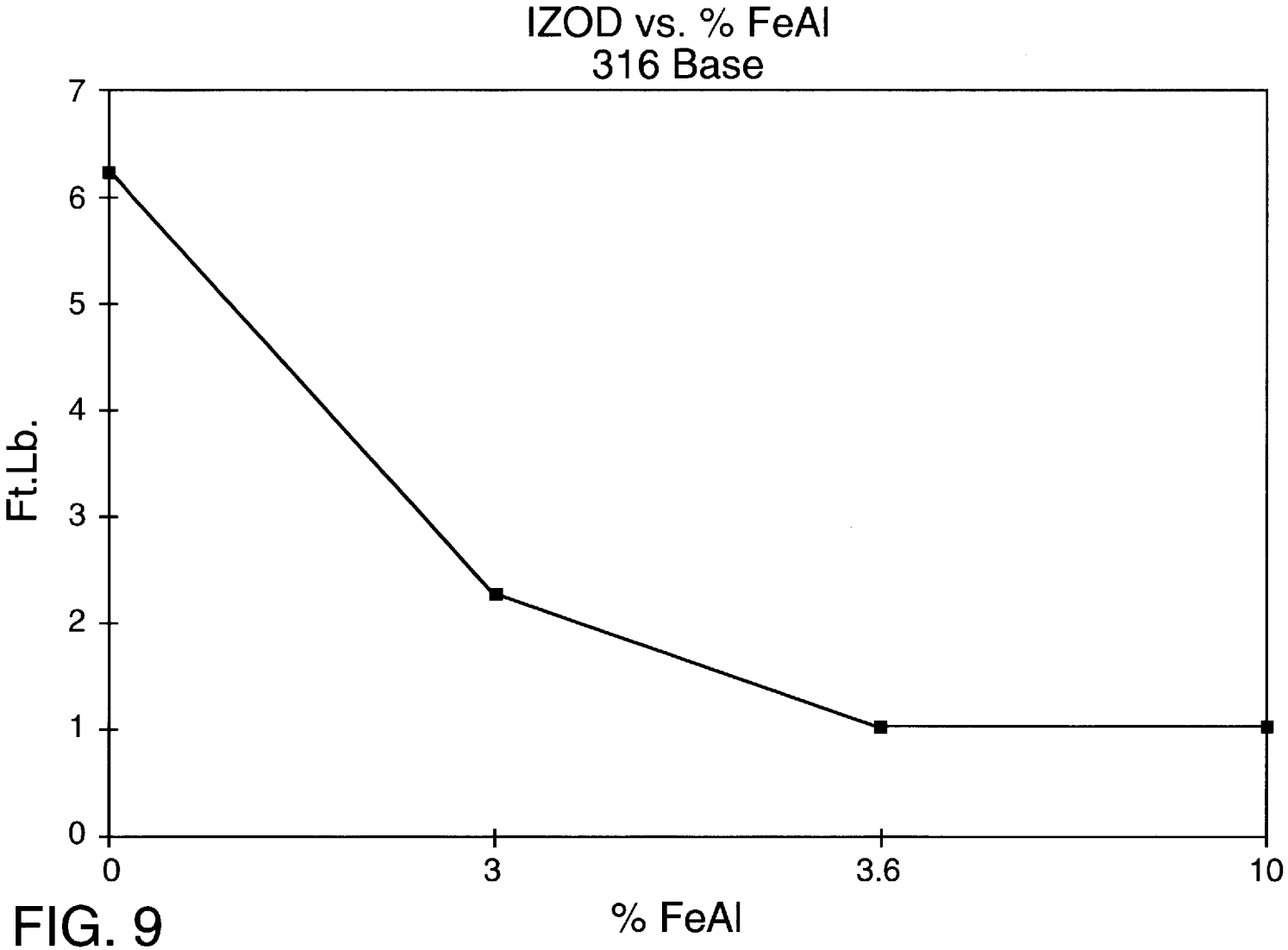
FIG. 9 is a plot of IZOD impact energy (ft.lb) vs. % addition of FeAl to the 316 base.

In the present invention, the introduction of aluminum in stainless and low alloy steels is to enhance the corrosion performance of the standard steel compositions. The aluminum is present in substantially dispersed and discrete form in the alloy, as shown by the discrete darker colored regions of FeAl in FIG. 1(*b*), and is not fully alloyed with the matrix metal. The enhanced corrosion performance of the standard powder ferrous composition with admixed powder aluminum containing compositions can allow for a reduction in the grade of the steel, i.e. a decrease in the amount of alloying elements, particularly chromium and nickel, normally required to achieve a desired level of corrosion and mechanical performance.

A number of tests were performed using a variety of ferrous-based powder metal compositions to characterize and evaluate the scope of the invention. The general applicability of the invention to stainless steels was tested using two representative stainless steel composition. Austenitic stainless steels were evaluated using an AISI 316L (Fe—Cr—Ni) stainless steel composition and martensitic and ferritic stainless steels were evaluated using an AISI 410L (Fe—Cr) stainless steel composition. These alloys were chosen because of the importance of the alloys in the automotive industry and the obvious utility of improved corrosion resistant alloys in this industry. In addition, specimens were prepared using the two modified stainless steel powders, 316 Ultra™ and 316 plus™, of Reinshagen.

Specimens made from standard ferrous compositions and from aluminum modified ferrous compositions were subjected to corrosion and mechanical testing. The specimens were prepared by the following method, except as otherwise noted. Standard 80 mesh steel powder was dry blended with 100 mesh FeAl alloy powder containing 50% aluminum by weight obtained from SCM Corp. NY, N.Y. and a suitable binding lubricant, in this case Acrawax, in a cone blender for approximately 20 minutes to form the aluminum containing blended powder. At least a portion of the blended powder was molded into green parts under pressures ranging from 30–60 tsi, and nominally 50 tsi. The green parts were sintered in a protective environment, either $N_2$, $H_2$, an $N_2/H_2$ mixture or a vacuum, for approximately 30 minutes at a temperature ranging from 2050° to 2300° F. The sintered parts were then cooled from the sintering temperature at a cooling rate of 40°–400° F. per minute, typically at 160° F./minute until a temperature less than 300° F. was reached. One skilled in the art will appreciate that the precise sintering conditions for the alloy will have to be varied as the stoichiometric quantities of iron and aluminum are varied, or if a different aluminum containing composition is used, to account for differences in the oxide films and other characteristics of the alloy that can vary required sintering conditions.

Testing with AISI 410L and 316L Stainless Steels

Specimens were formed in accordance with the aforementioned procedure and sintered at either 2100° F. or 2300° F. in a 95% $N_2$/5% $H_2$ atmosphere and cooled at 160° F./min. The specimens were tested for corrosion resistance by exposing one half of the specimen to 5% NaCl artificial seawater in a plastic vial and observing the days until rust was observed on the specimen. The vials were open to the air and water was added as needed to maintain a substantially constant water level and chloride concentration. Results of these tests are shown below:

| Stainless Steel Powder (AISI Number) | % FeAl alloy powder | % C added as graphite | Sintered Density g/cm$^3$ | Days to 1st Rust 2100° F. | Days to 1st Rust 2300° F. |
|---|---|---|---|---|---|
| 410L (base) | 0.0 | 0.0 | 6.67 | | <1 |
| 410L | 2.0 | 0.0 | 6.33 | | 8 |
| 410L | 2.0 | 0.2 | 6.30 | 32 | 20 |
| 410L | 2.0 | 0.8 | 6.10 | 16 | >21 |
| 410L | 5.0 | 0.0 | 6.15 | 50 | 25 |
| 410L | 5.0 | 0.4 | 6.15 | 32 | 25 |
| 410L | 10.0 | 0.0 | 5.80 | 4 | 10 |
| 410L | 10.0 | 0.4 | 5.85 | 2 | 21 |
| 316L (base) | 0.0 | 0.0 | 6.6 | <1 | <1 |
| 316L | 5.0 | 0.0 | 6.3 | 2 | 10 |
| 316L | 5.0 | 0.4 | 6.3 | 5 | 10 |
| 316 Ultra ™[1] | 0.0 | 0.0 | 6.61 | 15 | |
| 316 Plus ™[1] | 0.0 | 0.0 | 6.49 | 7 | |

[1]The test results shown for 316 U1tra ™ and 316 plus ™ were run on specimens that were sintered in a hydrogen-rich atmosphere at 2180° F. and slowly cooled in contrast to the stated test condition for the other specimens.

Rust generally first appeared in all specimens near the water/air interface. In all cases, the addition of the FeAl alloy greatly increased the corrosion resistance of the specimen over the base composition. The data also indicate that the heat treatment of the specimen and the percentage of carbon included in the composition also affect the corrosion performance of the composition. The corrosion resistance exhibits a test maximum at a composition containing approximately 5.0% of the 50% Al FeAl alloy or 2.5% Al. Based on these test results, similar improvements in corrosion performance of other types of stainless steels, such as precipitation hardened steels, and generally for powder stainless steels are expected.

It should be noted that the 410 stainless steel exhibited a substantial improvement in corrosion resistance compared not to only the base stainless steels, but to the more expensive 316 alloys. A substantial cost savings may be possible if aluminum containing 400 series stainless steels could be substituted for the more expensive 300 series steels in applications not requiring the mechanical characteristics associated with 300 series steels.

The mechanical properties of a number of specimens formed from powder 410L stainless steel mixed with varying amounts of the FeAl alloy were tested to provide a comparison of relevant mechanical properties. The results of the testing are shown in FIGS. 2–9. As can be seen, the addition of the FeAl alloy tends to decrease the modulus of rupture, density and fracture resistance of the alloy, but increases the hardness of the material, when subjected to the same mechanical processing as the base or standard stainless steel compositions. On this basis, test data derived to date indicates that adding aluminum to the base metal powder to produce a mixture having 2–7% of the 50% Al FeAl alloy, or 1.0–3.5% Al is more preferred to provide the benefit of increased resistance without greatly diminishing the mechanical properties of the resulting alloy.

Figure 10:
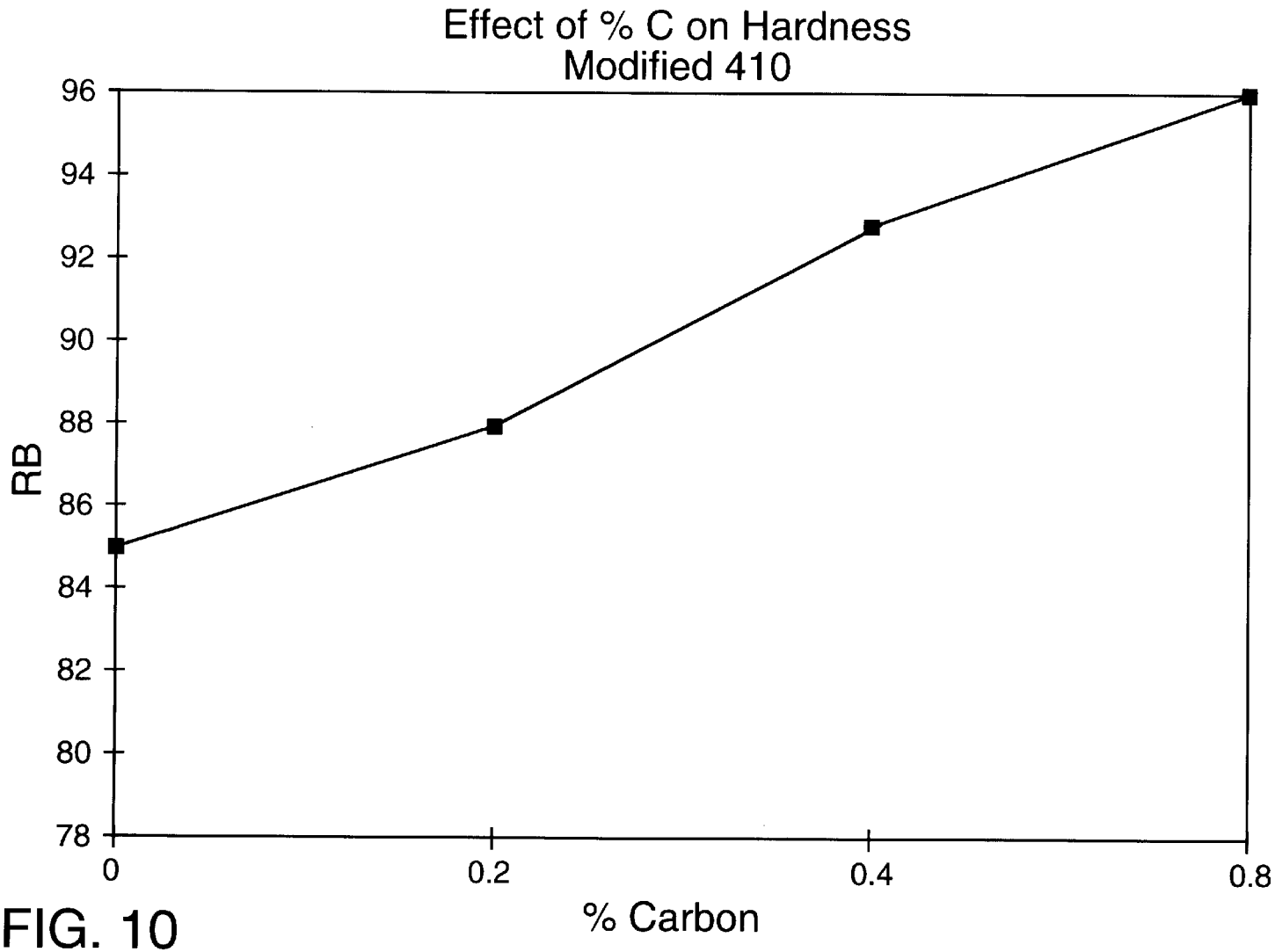
FIG. 10 is a plot of Rockwell B Hardness vs. % of C for a 410 base formed with 5% FeAl.
Figure 11:
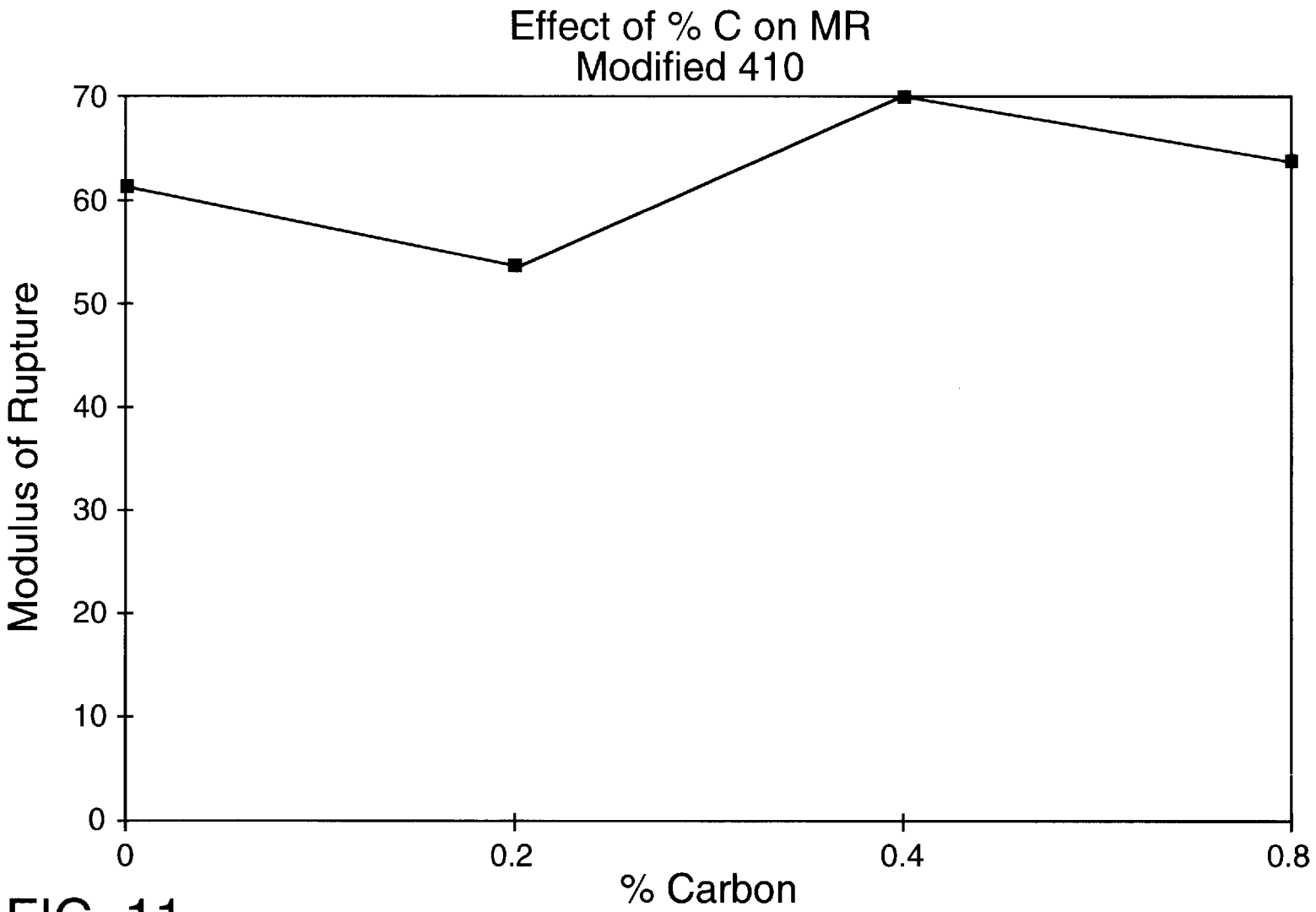
FIG. 11 is a plot of Modulus of Rupture (ksi) vs. % of C for a 410 base formed with 5% FeAl.

Additional mechanical and corrosion testing was performed on specimens formed from powder 410L stainless steel mixed with powder FeAl alloy and carbon in the form of flaked graphite to produce a mixture having 5% FeAl alloy and carbon ranging from 0.0–0.8%. The results of the testing, shown in FIGS. 10–12, indicate that the mechanical properties of the composition remain relatively constant over the entire range of carbon in the aluminum containing stainless steel alloy, as does the corrosion performance. The alloys exhibit good corrosion performance over a much greater range than the 410L stainless steels in the absence of the FeAl alloy. The stability of the aluminum containing steel alloys over a range of carbon contents is very important in powder metal applications because of the many potential sources of carbon contamination in powder metal processing, such as from binder material, residue in the mixing and thermal apparatuses, etc.

Figure 12:
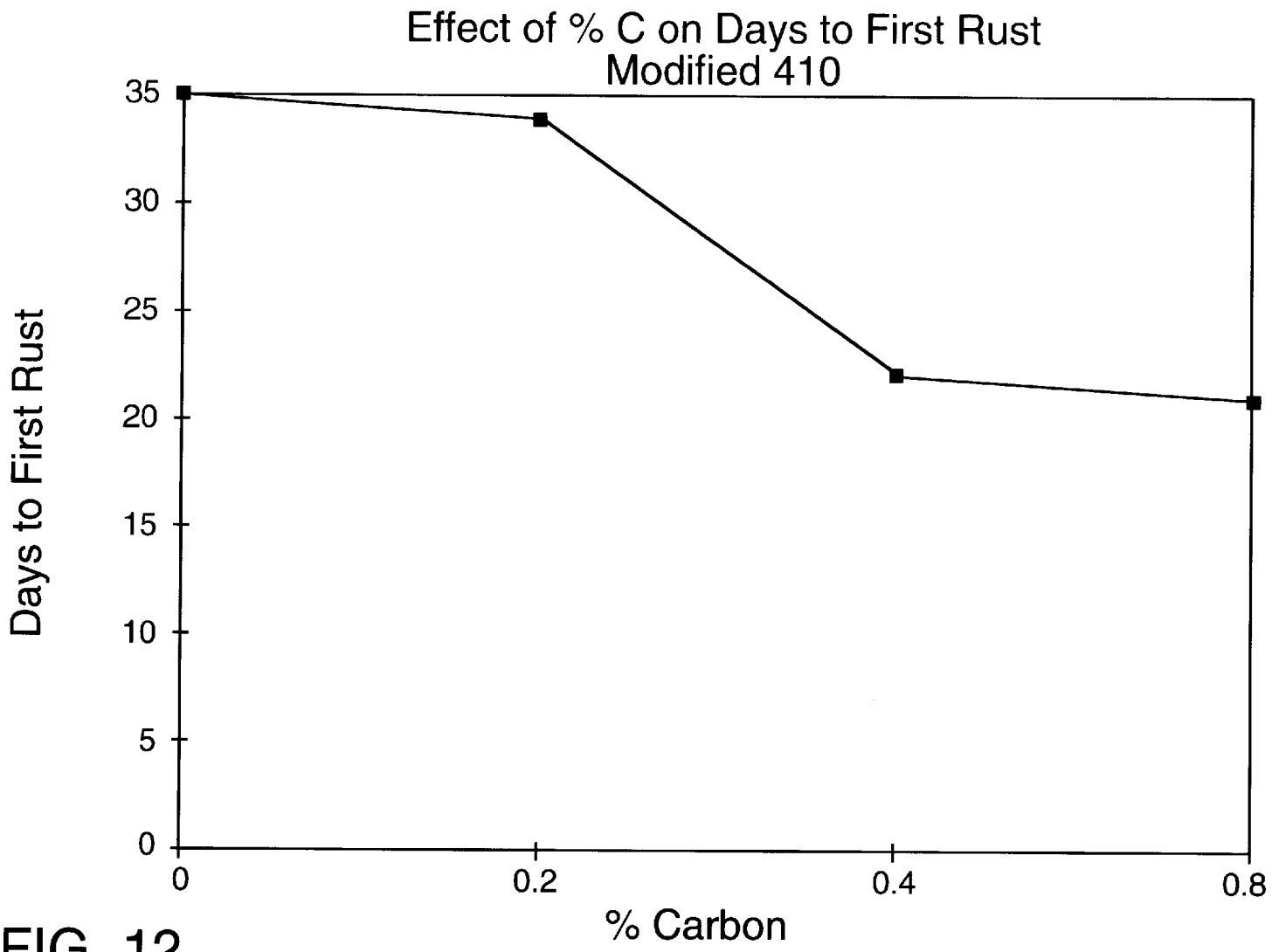
FIG. 12 is a plot of Days to First Rust vs. % of C for a 410 base formed with 5% FeAl; and, FIG. 13 is a plot of Rockwell B Hardness vs. Temper Temperature for 410 stainless steel and 410 stainless steel formed with 5% FeAl.
Figure 13:
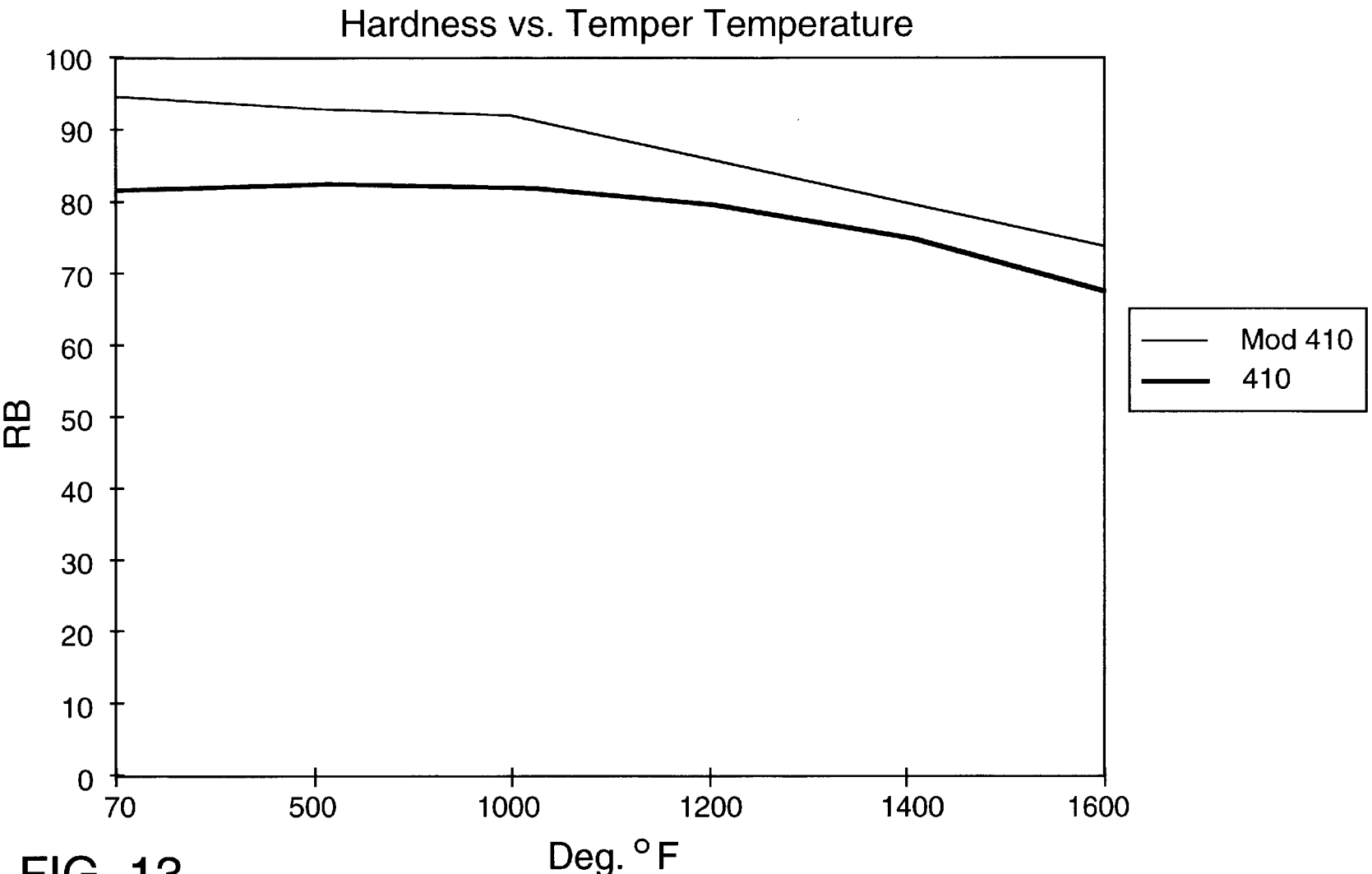

One potential application for the aluminum containing stainless steel alloys is for a flange in an automotive exhaust system that is exposed to temperatures approaching 1600° F. The temper resistance of a specimen formed from a mixture containing 410L steel powder and 5% FeAl alloy powder was tested and compared to standard 410L, as shown in FIG. 12. The specimen formed from the 410L/FeAl alloy mixture has a higher initial hardness than the base 410L, and the difference is essentially retained with increasing temperature. Also, it is possible that the addition of aluminum to the stainless steel may provide for parts having an increased high temperature oxidation resistance.

Low Alloy Steels

Low alloy steels typically exhibit much poorer corrosion resistance in chloride containing environments than stainless steels. Consequently, the more expensive stainless steels must be used for corrosive environment applications that do not otherwise require the enhanced mechanical and/or chemical properties found in stainless steels. A substantial cost savings could be realized if less expensive steels could be employed in corrosive environment applications that do not require the high temperature mechanical properties of stainless steels. To that end, additional testing was performed to determine whether powder metal parts produced from a mixture of powder aluminum compositions and powder low alloy steels exhibit increased corrosion performance. Specimens formed from standard AISI 4200, 4400 and 4600 low alloy steel powders and from blended mixture containing the low alloy steel powders and 5% of the 50% Al FeAl alloy powder were prepared and tested in the aforementioned manner; the results of which are shown below:

| AISI Alloy Number | Alloying Elements | % FeAl alloy Added | Days to First Rust |
|---|---|---|---|
| 4200 | 0.1 Ni - 0.6 Mo | 0.0 | <1 |
| 4200 | | 5.0 | 8 |
| 4400 | 0.85 Mo | 0.0 | <1 |
| 4400 | | 5.0 | 8 |
| 4600 | 1.8 Ni - 0.6 Mo | 0.0 | <1 |
| 4600 | | 5.0 | 15 |

The addition of aluminum to the low alloy steel greatly increases the corrosion resistance of the steels. The corrosion test results do indicate that the increased corrosion resistance observed when aluminum is added to iron-chromium alloys can also be achieved in molybdenum and Ni/Mo iron alloys and suggest a similar benefit for Fe—Ni alloys. The increased performance of the AISI 4600 steel in comparison with the AISI 4200 steel may be indicative of a beneficial interaction between the Al and the increased levels of Ni in the AISI 4600 steel. The favorable interaction of the powder aluminum composition mixed with alloys representing some of the more common alloying elements indicates that the invention may be applicable to low alloy steels, in general, and may have application to other iron alloys.

The increased corrosion resistance of the low alloy steels containing aluminum may provide a low cost alternative to the use of stainless steels in corrosive environment applications. The aluminum containing low alloy steel shows substantially improved corrosion performance compared to the standard or base 410L. As shown in the table below, there is a reduction in the modulus of rupture (MR) in comparison with low alloy steels; however, there is an increase of the hardness (Hard) of the Al containing low alloy blended steels.

Mechanical Properties of Low-Alloy Grade Steels

| | Base Alloy | | Base alloy admixed w/3.0% FeAl alloy | | Base alloy admixed w/5.0% FeAl alloy | |
|---|---|---|---|---|---|---|
| AISI Alloy Number | MR (ksi) | Hard[1] (RH) | MR (ksi) | Hard (RB) | MR (ksi) | Hard (RB) |
| 4200 | 110 | 89 | 60 | 51 | 30 | 52 |
| 4400 | 115 | 88 | 59 | 58 | 24 | 50 |
| 4600 | 100 | 96 | 45 | 45 | 35 | 48 |

[1]Note the hardness for the alloys is in different units due to the difference in the hardness of the material requiring different test methods. A hardness of approximately 90 on the Rockwell H (RN) scale corresponds to approximately 11 on the Rockwell B (RB) scale and a RH value of 100 corresponds to an RB value of 36.

Pure Iron

Additional testing was further performed using pure iron powder in combination with the aluminum containing compositions. Specimens were prepared and tested in accordance with the aforementioned procedure. In addition to the FeAl alloy obtained from SCM, a 50% Al FeAl alloy obtained from Ametek Specialty Metals, of Eighty-Four, PA was used to form specimens for testing. The results of the mechanical and corrosion testing are shown in the table below:

| Composition | Density g/cc | Hardness | Modulus of Rupture (ksi) | IZOD Impact ft.lb | Days to 1st Rust |
|---|---|---|---|---|---|
| 100% Fe | 7.0 | 90 (RH) | 52 | ? | <1 |
| Fe-1.5% Al (SCM) | 7.0 | 40 (RB) | 50 | 2.0 | 6 |
| Fe-1.5% Al (Ametek) | 7.15 | 42 (RB) | 80 | 11.0 | 4 |

As can be seen, the addition of the FeAl alloy significantly increases the corrosion resistance of the modified iron specimen. Also, there is an increase in the hardness of the material over pure iron compositions. In addition, there is a substantial increase in the impact resistance of the modified iron composition using the FeAl alloy obtained from Ametek compared to the alloy prepared using pure iron modified with the FeAl alloy obtained from SCM.

Additional Testing

Additional sources of aluminum were tested, namely Al-4.4% Cu-0.8 Si-0.5 Mg, Al-0.25% Cu-0.6 Si-1.0 Mg, and Al-12 Si in place of FeAl alloys. The aluminum alloys were blended with AISI 410L and 316L and formed into parts using the same conditions as were used for the FeAl alloy modified parts. The Al-Cu-Si-Mg specimens showed excessive swelling during part sintering that resulted in low density and poor mechanical properties. Corrosion testing of the Al-Cu-Si-Mg parts showed no improvement in corrosion resistance over standard stainless steels as might be expected based on the swelling of the samples. However, the Al-12 Si parts did not exhibit excessive swelling and increased the time to rust of the base 410L alloy from <1 day to approximately 15 days.

The variation in the corrosion performance of the stainless steel admixed with aluminum alloys is presumably due to the variation in the oxide films on the aluminum containing compositions and the necessary sintering conditions for each composition. For example, the Al-Cu-Si-Mg powders are highly alloyed in aluminum, approximately 95% and 98%, respectively, which results in an alloy having a nearly pure aluminum oxide film. The pure aluminum oxide film is most likely not reduced using the sintering procedure developed for combining FeAl alloy powder with stainless and low alloy steels. Whereas, the oxide film on the Al-12 Si powder is probably less tenacious, due to the lower Al content, and can be reduced and alloyed with the matrix metal to a greater extent than the films on the Al-Cu-Si-Mg alloys. One skilled in the art will appreciate, as discussed above, that the compacting and sintering conditions used to form the alloy should be selected in view of the admixed aluminum containing composition.

Specimens formed from standard AISI 316L and 410L powder stainless steels and from 316L and 410L powder stainless steels admixed with FeAl alloy were vacuum impregnated at room temperature with a polyester resin, commercially sold as Imprec, cured at 195° F. in hot water and air cooled prior to corrosion testing. The test specimens had previously been sintered at 2100°–2300° F. and cooled in a protective atmosphere at greater than 100° F.

The impregnated standard, or base, composition specimens showed a slight improvement over the unimpregnated standard specimens. The time to rust increased 6–12 hours, presumably due to the resin filling the pore space in the specimen. In contrast, the specimens formed with a mixture of FeAl alloy and stainless steel dramatically decreased in the time to rust from over 30 days for 410L containing 2.5% Al to less than a day. The cause of this result is uncertain at this time, but it is believed that the resin, or the hot water exposure during curing may have facilitated the breakdown of the steel/aluminum structure in the specimen.

A limitation on the aluminum compounds that could be used in the present invention is that the aluminum in the composition must be capable of being reduced at temperatures less than the melting point of the steel powder. In addition, consideration must be given to the other elements contained in the aluminum composition to minimize the potential for contamination of the modified stainless steel composition by the other elements.

Those of ordinary skill in the art will also appreciate that the present invention provides significant advantages over the prior art. In particular, the subject invention provides modified powder metal stainless and low alloy steel compositions for use in forming machine parts that exhibit increased corrosion resistance over conventional powder metal compositions; and therefore, can be used in a much wider range of applications at a generally reduced cost. While the subject invention provides these and other advantages over the prior art, it will be understood, however, that various changes in the details, compositions and ranges of the elements which have been herein described and illustrated in order to explain the nature of the invention may be made by those skilled in the art within the principle and scope of the invention as expressed in the appended claims.

What is claimed is:

1. A method of producing a powder metal part comprising a ferrous metal matrix and discrete aluminum-containing particles dispersed within said matrix, the method comprising the steps of:

providing a powder ferrous metal composition;

admixing a powder aluminum-containing composition to the ferrous composition to produce a blended mixture comprising less than 5 weight percent chromium; and forming at least a portion of the blended mixture to produce the powder metal part.

2. The method of claim 1, wherein said step of admixing aluminum comprises admixing a sufficient amount of the powder aluminum containing composition to produce a blended mixture containing 0.5–5.0 weight % aluminum.

3. The method of claim 2, wherein said step of admixing aluminum comprises admixing aluminum in the form of an FeAl alloy powder.

4. The method of claim 3, wherein said step of admixing aluminum comprises admixing an FeAl alloy powder having a approximately 50 weight % Al in the FeAl alloy powder.

5. The method of claim 4, wherein said step of admixing aluminum comprises admixing an FeAl alloy powder to produce a blended mixture containing aluminum in a range of 1.5–3.5 weight %.

6. The method of claim 3, wherein said step of providing comprises providing a powder ferrous metal composition selected from the group consisting of AISI 4000 series low alloy steel and pure iron.

7. The method of claim 3, wherein said step of providing comprises providing a powder ferrous metal composition selected from the group consisting of AISI 4200 low alloy steel, AISI 4400 low alloy steel, AISI 4600 low alloy steel, and pure iron.

8. The method of claim 1, wherein said step of forming further comprises the steps of:

compacting at least a portion of the blended mixture to produce a green part; and, sintering the green part to produce the powder metal part.

9. The method of claim 8, wherein said step of compacting further comprises applying pressure ranging from 30 to 60 tsi to at least a portion of the blended mixture.

10. The method of claim 8, wherein said step of sintering comprises sintering the green part at a temperature ranging from 2050° F. to 2300° F. in a reducing atmosphere.

11. The method of claim 8, further comprising the step of cooling the sintered part.

12. The method of claim 11, wherein said step of cooling comprises cooling at a rate of at least 40° F./min.

13. The method of claim 11, wherein said step of cooling comprises cooling at approximately 160° F./min.

14. A powder ferrous metal part produced according to the method of claim 1 and comprising a ferrous metal matrix and discrete aluminum-containing particles dispersed within said matrix.

15. A method of increasing the corrosion resistance of a ferrous metal composition for use in forming powder metal parts comprising a ferrous metal matrix and discrete aluminum-containing particles dispersed within said matrix, the method comprising:

providing a powder ferrous metal composition; and, admixing a powder aluminum-containing material with the ferrous metal composition to produce a blended mixture comprising less than 5 weight % chromium.

16. The method of claim 15, wherein said step of admixing aluminum comprises admixing aluminum in the form of FeAl alloy powder to produce a blended mixture containing 0.5–5.0 weight % aluminum.

17. The method of claim 15, wherein said step of providing comprises providing a powder ferrous metal composition selected from the group consisting of AISI 4000 series low alloy steel and pure iron.

18. The method of claim 15, wherein said step of providing comprises providing a powder ferrous metal composition selected from the group consisting of AISI 4200 low alloy steel, AISI 4400 low alloy steel, AISI 4600 low alloy steel, and pure iron.

19. A powder metal composition for use in forming powder metal parts comprising a ferrous metal matrix and discrete aluminum-containing particles dispersed within said matrix, the powder metal composition produced according to the method of claim 18, said powder metal composition comprising less than 5 weight % chromium.

20. A powder metal mixture for use in forming powder metal parts comprising a ferrous metal matrix and discrete aluminum-containing particles dispersed within said matrix, the powder metal mixture comprising a powder aluminum-containing composition and a ferrous metal powder, said powder metal mixture comprising less than 5 weight % chromium.

21. The powder metal mixture of claim 20, wherein said aluminum containing composition comprises FeAl alloy powder.

22. A method of producing a powder metal part comprising a ferrous metal matrix and discrete aluminum-containing particles dispersed within said matrix, said method comprising:

forming a blended mixture comprising a powder FeAl alloy and a ferrous powder composition selected from the group consisting of AISI 4200 low alloy steel, AISI 4400 low alloy steel, and AISI 4600 low alloy steels;

compacting at least a portion of the mixture to form a green part; and, sintering the green part to form the powder metal part, the part comprising less than 5 weight percent chromium.

23. The method of claim 22, where said step of forming comprises forming a blended mixture containing 0.5–5.0 weight % aluminum.

24. A powder metal part formed by the method of claim 23, said powder metal part comprising a ferrous metal matrix and discrete aluminum-containing particles dispersed within said matrix.

25. A powder metal part comprising: 0.5–5.0 weight % aluminum;

less than 5 weight percent chromium; and a ferrous metal matrix, wherein said aluminum is present as discrete aluminum-containing particles in said ferrous metal matrix.

26. The powder metal part of claim 25, wherein said discrete aluminum-containing particles are iron-aluminum particles.

27. The powder metal part of claim 25, wherein the ferrous metal of said ferrous metal matrix is selected from the group consisting of AISI 4000 series low alloy steel and pure iron.

28. The powder metal part of claim 25, wherein the ferrous metal of said ferrous metal matrix is selected from the group consisting of AISI 4200 low alloy steel, AISI 4400 low alloy steel, AISI 4600 low alloy steel and pure iron.

29. A powder metal part comprising a ferrous metal matrix, discrete aluminum-containing particles dispersed within said matrix, and less than 5 weight percent chromium by weight, said powder metal part prepared from a powder mix comprising the following ingredients:

a powder aluminum containing composition; and, a powder ferrous metal.

30. The powder metal part of claim 29, wherein said powder aluminum containing composition comprises a powder FeAl alloy.

31. The powder metal part of claim 30, wherein said powder FeAl alloy contains aluminum present in a range of 0.5–5.0% by weight of the metal part.

32. The powder metal part of claim 30, wherein said powder FeAl alloy contains aluminum present in a range of 1.0–3.5% by weight of the metal part.

33. The powder metal part of claim 29, wherein the ferrous metal of said ferrous metal matrix is selected from the group consisting of AISI 4000 series low alloy steel and pure iron.

34. The powder metal part of claim 29, wherein said powder ferrous metal is selected from the group consisting of AISI 4200 low alloy steel, AISI 4400 low alloy steel, AISI 4600 low alloy steel and pure iron.

35. The powder metal part of claim 29, further comprising a binding lubricant.

36. A method of producing a powder metal part comprising a ferrous metal matrix and discrete aluminum-containing particles dispersed within said matrix, said method comprising the steps of:

providing a powder ferrous metal composition;

admixing a powder aluminum containing composition to the ferrous composition to produce a blended mixture comprising 0.5 to less than 2 weight % aluminum; and forming at least a portion of the blended mixture to produce said powder metal part.

37. The method of claim 36, wherein said step of providing comprises providing a powder ferrous metal composition selected from the group consisting of AISI 300 series stainless steel, AISI 400 series stainless steel, AISI 4000 series low alloy steel and pure iron.

38. The method of claim 36, wherein said step of providing comprises providing a powder ferrous metal composition selected from the group consisting of AISI 316 stainless steel, AISI 410 stainless steel, AISI 4200 low alloy steel, AISI 4400 low alloy steel, AISI 4600 low alloy steel and pure iron.

39. The method of claim 36, wherein said step of providing comprises providing a powder ferrous metal composition selected from the group consisting of austenitic steel, ferritic steel, and martensitic steel.

40. The method of claim 36, wherein said step of admixing aluminum comprises admixing aluminum in the form of an FeAl alloy powder.

41. The method of claim 40, wherein said step of admixing aluminum comprises admixing an FeAl alloy powder having approximately 50 weight % Al in the FeAl alloy powder.

42. The method of claim 36, wherein said step of forming further comprises the steps of:

compacting at least a portion of the blended mixture to produce a green part; and sintering the green part to produce the powder metal part.

43. The method of claim 42, wherein said step of compacting further comprises applying pressure ranging from 30 to 60 tsi to at least a portion of the blended mixture.

44. The method of claim 42, wherein said step of sintering comprises sintering the green part at a temperature ranging from 2050° F. to 2300° F. in a reducing atmosphere.

45. The method of claim 42, further comprising the step of cooling the sintered part.

46. A powder ferrous metal part produced according to the method of claim 36 and comprising a ferrous metal matrix and discrete aluminum-containing particles dispersed within said matrix.

47. A method of increasing the corrosion resistance of a ferrous metal composition for use in forming powder metal parts comprising a ferrous metal matrix and discrete aluminum-containing particles dispersed within said matrix, the method comprising:

providing a powder ferrous metal composition; and, admixing an aluminum containing material with the ferrous metal composition to produce a blended mixture comprising 0.5 to less than 2 weight % aluminum.

48. The method of claim 47, wherein said step of providing comprises providing a powder ferrous metal composition selected from the group consisting of AISI 300 series stainless steel, AISI 400 series stainless steel, AISI 4000 series low alloy steel and pure iron.

49. The method of claim 47, wherein said step of providing comprises providing a powder ferrous metal composition selected from the group consisting of AISI 316 stainless steel, AISI 410 stainless steel, AISI 4200 low alloy steel, AISI 4400 low alloy steel, AISI 4600 low alloy steel, and pure iron.

50. The method of claim 47, wherein said step of providing comprises providing a powder ferrous metal composition selected from the group consisting of austenitic steel, ferritic steel and martensitic steel.

51. A powder metal composition for producing powder metal parts comprising a ferrous metal matrix and discrete aluminum-containing particles dispersed within said matrix, the powder metal composition produced according to the method of claim 47.

52. A powder metal mixture for use in forming powder metal parts comprising a ferrous metal matrix and discrete aluminum-containing particles dispersed within said matrix, the powder metal mixture comprising a powder aluminum containing composition and a ferrous metal powder, said powder metal mixture comprising 0.5 to less than 2 weight % aluminum by total weight of said powder metal mixture.

53. The powder metal mixture of claim 52, wherein said aluminum containing composition comprises FeAl alloy powder.

54. The powder metal mixture of claim 52 wherein said ferrous metal powder is selected from the group consisting of AISI 300 series stainless steel, AISI 400 series stainless steel, AISI 4000 series low alloy steel and pure iron.

55. The powder metal mixture of claim 52 wherein said ferrous metal powder is selected from the group consisting of AISI 316 stainless steel, AISI 410 stainless steel, AISI 4200 low alloy steel, AISI 4400 low alloy steel, AISI 4600 low alloy steel and pure iron.

56. The powder metal mixture of claim 52 wherein said ferrous metal powder is selected from the group consisting of austenitic steel, ferritic steel, and martensitic steel.

57. A powder metal part comprising:

0.5 to less than 2 weight % aluminum; and, a ferrous metal matrix, wherein said aluminum is present in discrete aluminum-containing particles dispersed within said ferrous metal matrix.

58. The powder metal part of claim 57, wherein said discrete aluminum-containing particles are iron-aluminum particles.

59. The powder metal part of claim 57, wherein the ferrous metal of said ferrous metal matrix is selected from the group consisting of AISI 300 series stainless steel, AISI 400 series stainless steel, AISI 4000 series low alloy steel and pure iron.

60. The powder metal part of claim 57, wherein the ferrous metal of said ferrous metal matrix is selected from the group consisting of AISI 316 stainless steel, AISI 410 stainless steel, AISI 4200 low alloy steel, AISI 4400 low alloy steel, AISI 4600 low alloy steel and pure iron.

61. The powder metal part of claim 57, wherein the ferrous metal of said ferrous metal matrix is selected from the group consisting of austenitic steels, ferritic steels, and martensitic steels.

62. A powder metal part comprising a ferrous metal matrix, discrete aluminum-containing particles dispersed within said matrix, and 0.5 to less than 2.0 weight percent aluminum, the powder metal part prepared from a powder mix comprising the following ingredients:

a powder aluminum containing composition; and a powder ferrous metal.

63. The powder metal part of claim 62, wherein said powder aluminum-containing composition comprises a powder FeAl alloy.

64. The powder metal part of claim 62, further comprising a binding lubricant.

65. The powder metal part of claim 62, wherein said powder ferrous metal is selected from the group consisting of AISI 300 series stainless steel, AISI 400 series stainless steel, AISI 4000 series low alloy steel and pure iron.

66. The powder metal part of claim 62, wherein said powder ferrous metal is selected from the group consisting of AISI 316 stainless steel, AISI 410 stainless steel, AISI 4200 low alloy steel, AISI 4400 low alloy steel, AISI 4600 low alloy steel and pure iron.

67. The powder metal part of claim 62, wherein said powder ferrous metal is selected from the group consisting of austenitic steel, ferritic steel, and martensitic steel.

* * * * *

UNITED STATES PATENT AND TRADEMARK OFFICE

CERTIFICATE OF CORRECTION

PATENT NO. : 5,864,071
DATED : January 26, 1999
INVENTOR(S) : John C. Kosco

It is certified that error appears in the above-indentified patent and that said Letters Patent is hereby corrected as shown below:

On the title page: Item [56] , under "References Cited" to include the following:

FOREIGN PATENT DOCUMENTS

| | | |
|---|---|---|
| 482,837 | 1/1970 | Switzerland |
| 89305904.8 | 1/1990 | European Patent Office |

Signed and Sealed this

Seventh Day of November, 2000

*Attest:*

Q. TODD DICKINSON

*Attesting Officer*

*Director of Patents and Trademarks*